US005498205A

United States Patent [19]

Knowles et al.

[11] Patent Number: 5,498,205

[45] Date of Patent: Mar. 12, 1996

[54] ROOF VENTILATOR

[76] Inventors: James A. Knowles, 608 S. Cumberland St., Wallace, N.C. 28466; Larry M. Knowles; Joseph Knowles, both of 1254 Cornwallis Rd., Rose Hill, N.C. 28458

[21] Appl. No.: 285,711

[22] Filed: Aug. 4, 1994

[51] Int. Cl.[6] ..... F24F 7/02

[52] U.S. Cl. ..... 454/363; 454/364

[58] Field of Search ..... 454/363, 364, 454/365, 367, 368

[56] References Cited

U.S. PATENT DOCUMENTS

| | | | |
|---|---|---|---|
| 909,472 | 1/1909 | Steele . | |
| 1,654,855 | 1/1928 | Bastien | 454/363 |
| 2,601,423 | 6/1952 | Allman et al. . | |
| 2,737,876 | 3/1956 | Smith | 454/368 |
| 2,923,225 | 2/1960 | Massey | 454/364 X |
| 3,862,529 | 1/1975 | Markos | 454/365 X |

FOREIGN PATENT DOCUMENTS

| | | | |
|---|---|---|---|
| 193775 | 3/1923 | United Kingdom | 454/364 |
| 632006 | 11/1949 | United Kingdom | 454/365 |

OTHER PUBLICATIONS

U.S. Pat. No. 4,957,037, *Official Gazette,* Sep. 18, 1990, p. 1346.

U.S. Pat. No. 5,022,314, *Official Gazette,* Jun. 11, 1991, p. 775.

U.S. Pat. No. 5,092,225, *Official Gazette,* Mar. 3, 1992, p. 90.

U.S. Pat. No. 5,122,095, *Official Gazette,* Jun. 16, 1992, p. 1636.

*Primary Examiner*—Harold Joyce

*Attorney, Agent, or Firm*—John G. Mills and Associates

[57] ABSTRACT

A roof-type ventilator made of a moldable material such as fiberglass with generally vertical sides. Exhaust ports are provided in the upper portion of opposite sides of the ventilator in spaced relation from the roof. Deflecting baffles extend from just below the exhaust openings inwardly to just above the exhaust openings with an opening behind the deflector communicating with the interior of the building. This allows air and fumes from the interior of the building to be exhausted generally horizontally outwardly from the elevated exhaust port while preventing ambient, wind driven rain, snow and the like from entering the building interior through the ventilator. A normally open louver is provided in the area behind the baffles so that the air and fumes from the interior of the building can be controlled.

7 Claims, 3 Drawing Sheets

ROOF VENTILATOR

FIELD OF INVENTION

This invention relates to air circulation means and more particularly to roof-type ventilators.

BACKGROUND OF INVENTION

It is well known that the rafter area of open buildings and the attic of enclosed buildings tend to accumulate vast amounts of heat since hot air is lighter than cooler air.

Accumulated gasses, hot, humid air, dust and the like from houses, hog facilities, poultry houses, and the like all have a need to vent the under roof areas and to create air circulation through out the interior thereof.

To meet the need of ventilating roof areas, various means have been developed from simple roof ridge ventilators to relatively complex combinations of skylights and ventilators.

Many of the prior known roof-type ventilators and ridge ventilators are susceptible to receiving water thereinto during driving rainstorms and other severe weather. Also if corrosive by-product gasses from hog facilities, poultry houses and the like as well as gaseous by-products from manufacturing processes are vented on or in close proximity to the roof, such gasses can cause rust and other surface damage. Also the corrosive gasses can cause severe rusting of the ventilators themselves if formed from a ferrous-type metal or severe oxidation of aluminum or similar metals.

Concise Explanation of Prior Art References

U.S. Pat. No. 2,923,225 to Massey discloses a roof ventilator with roof ports on either side thereof facing downwardly at approximately a 45 degree angle. This is more or less a standard of prior art roof ventilators.

The Patent to Allman et al discloses a ventilator that is designed to exhaust air from a structure while providing baffles to prevent wind and wind driven rain or snow from entering the building through the ventilator. This ventilator exhausts upwardly and would be relatively expensive and complex to manufacture and install.

U.S. Pat. No. 2,214,183 to Seymour includes a curved interior baffle to prevent rain, snow and the like from entering the ventilator. The exhaust gasses, however, exit adjacent roof in a downwardly direction thereagainst.

U.S. Pat. No. 4,957,037 to Tubbesing et al, U.S. Pat. No. 5,022,314 to Waggoner, U.S. Pat. No. 5,092,225 to Sells and U.S. Pat. No. 5,122,095 to Wolfert are all considered of general interest in that they disclose roof ridge ventilators that are mounted juxtapose to the roof with openings on the edges thereof which would make the roof subject to corrosion and other damage from exhaust gasses as well as being susceptible to ingress of driven rain and snow.

Finally, U.S. Pat. No. 909,472 is considered of interest in that it discloses a combination skylight and ventilator with a series of pulleys used to manipulate the same.

BRIEF DESCRIPTION OF INVENTION

After much research and study into the above mentioned problems, the present invention has been developed to provide a relatively high, roof-type ventilator that allows air escaping therefrom, along with any corrosive gasses mixed thereinto, to be released well above the roof of the structure thus preventing rust, corrosion and other degradation of said roof.

The ventilator of the present invention is constructed from fiberglass or other non-corrosive material with interior baffles molded thereinto to prevent the ingress of ambient water and other airborne materials during severe ambient weather including high wind conditions.

The ventilator is molded in two separate sections which greatly reduces the cost of production while at the same time providing greater structural strength and integrity.

A simple damper constructed of fiberglass or other non-corrosive material is provided and is so configured that it is naturally biased to an open position but can be readily maneuvered to a closed position.

In view of the above it is an object of the present invention to provide an improved roof-type ventilator with exhaust ports being vertically disposed so the exhaust air and fumes will move therefrom in a generally horizontal direction.

An object of the present invention is to provide an improved roof ventilator that is constructed of non-corrosive material.

Another object of the present invention is to provide an improved roof-type ventilator that is molded from a non-corrosive material.

Another object of the present invention is to provide an improved roof-type ventilator that is molded in two separate parts from a non-corrosive material to provide a unit that can be readily manufactured while at the same time providing superior strength in the complete unit.

Another object of the present invention is to provide, in an improved roof ventilator, a cut-off louver that is biased to an open position but can readily be pivoted to a closed position.

Other objects and advantages of the present invention will become apparent and obvious from a study of the following description and the accompanying drawings which are merely illustrative of such invention.

DETAILED DESCRIPTION OF INVENTION

Figure 1:
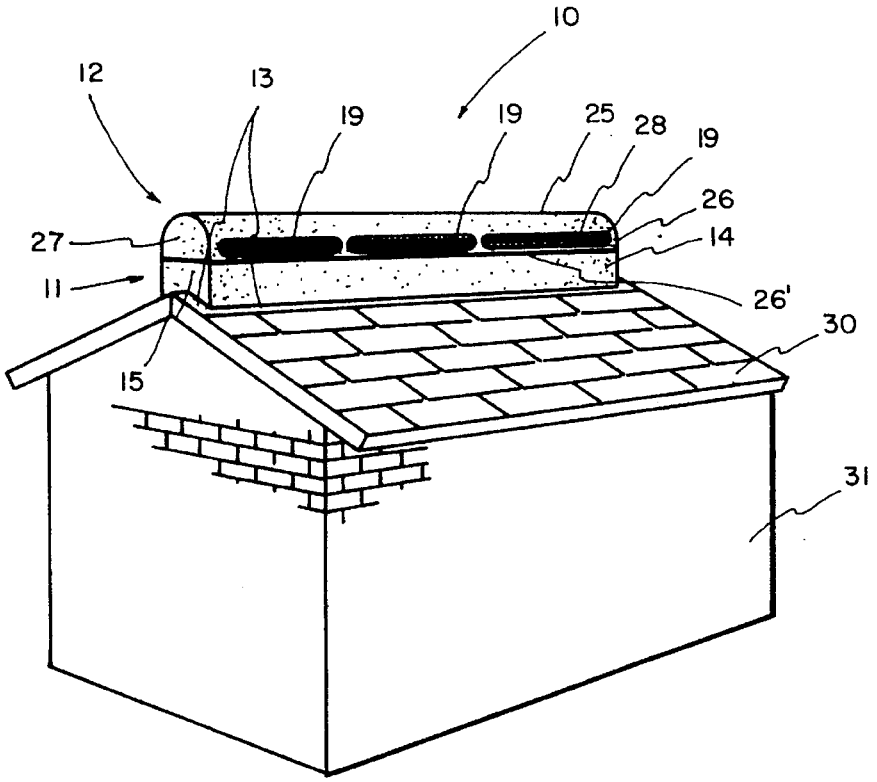
FIG. 1 is a perspective view of a building with the improved roof ventilator of the present invention mounted thereon.

With further reference to the drawings, the improved roof ventilator of the present invention, indicated generally at 10, includes a base portion, indicated generally at 11 and a cap portion, indicated generally at 12. Both the base and the cap portions are so designed that they can readily be molded from fiberglass or other suitable material that is non-corrosive.

The base portion 11 includes an outwardly projecting flange 13 that extends about the lower periphery thereof. Generally vertically disposed side walls 14 and end walls 15 define an enclosure with peripheral flange 11 outwardly and downwardly projecting from the lower portion of said walls.

Figure 5:
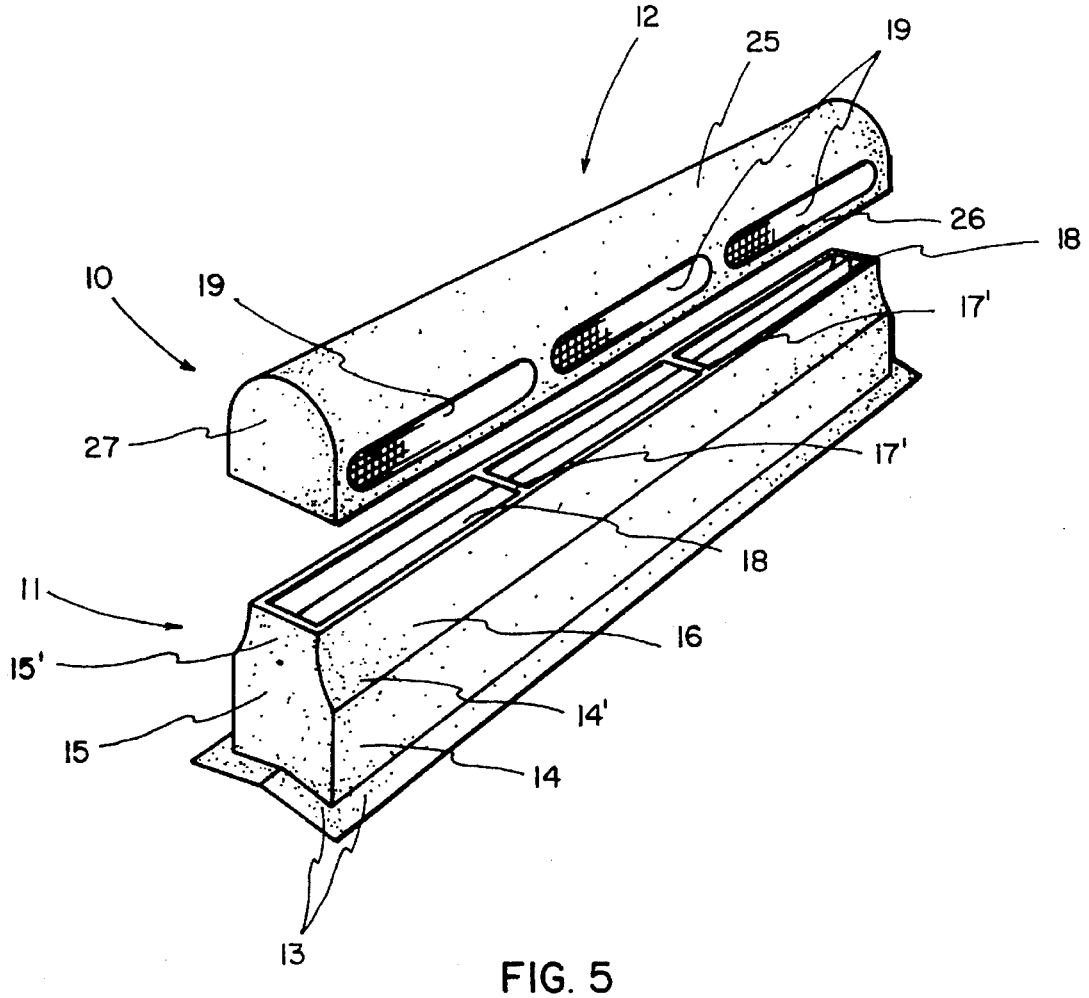
FIG. 5 is an exploded perspective view of the base and cap portion of the present invention.

An inwardly and upwardly curved baffle 16 is formed along the upper edge 14' of each of the side walls 14. The upper portion 15' of end walls 15 conform to this configuration as can clearly be seen in exploded FIG. 5.

Figure 2:
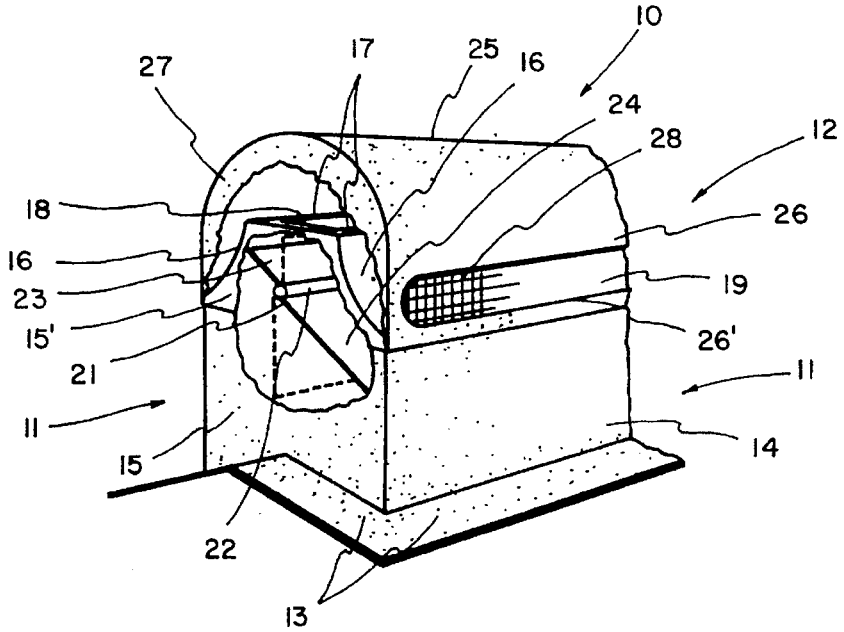
FIG. 2 is an enlarged, partially cut-away view of the ventilator.
Figure 3:
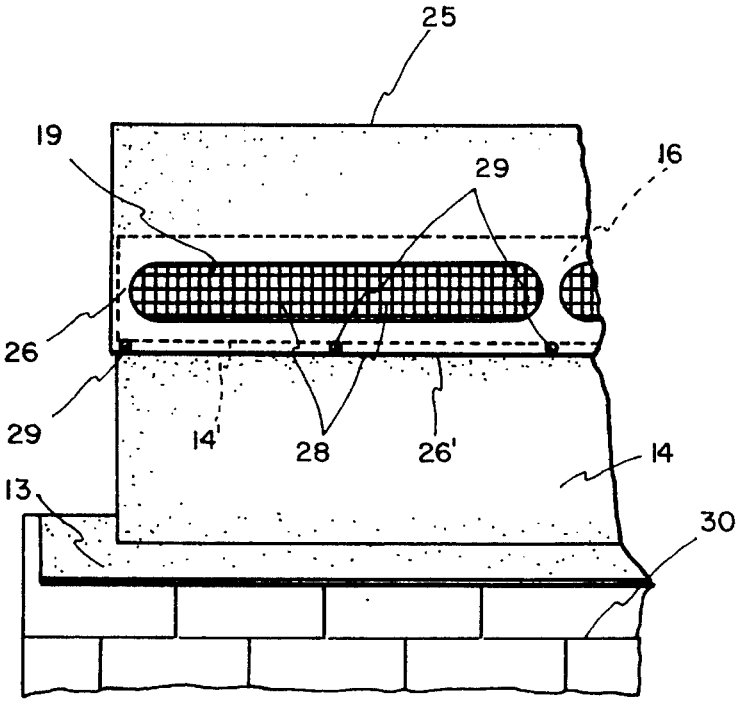
FIG. 3 is a side elevational view of said ventilator.

An upper flange 17 is provided about the upper edges of the deflecting baffles 16 and the upper edge of the upper portion 15' of end walls 15 as can clearly be seen in FIG. 2. This flange is formed by cutting out the upper portion of the base portion 11 after it has been molded. These cutouts, indicated at 18, communicate the interior of the base portion 11.

These cutout openings 18 are in vertical alignment with the exhaust ports 19 in the cap portion 12 as will hereinafter be described in greater detail. The areas between the cutouts 18 are left as molded thus forming integral cross braces 17' extending periodically across the upper portions of the interior deflecting baffle 16.

A support bearing 20 is provided each end on the inside of the base portion 11 approximately in horizontal alignment with the juncture between the upper edge of the side walls 14 and the lower edge of the interior deflecting baffles 16.

Figure 4:
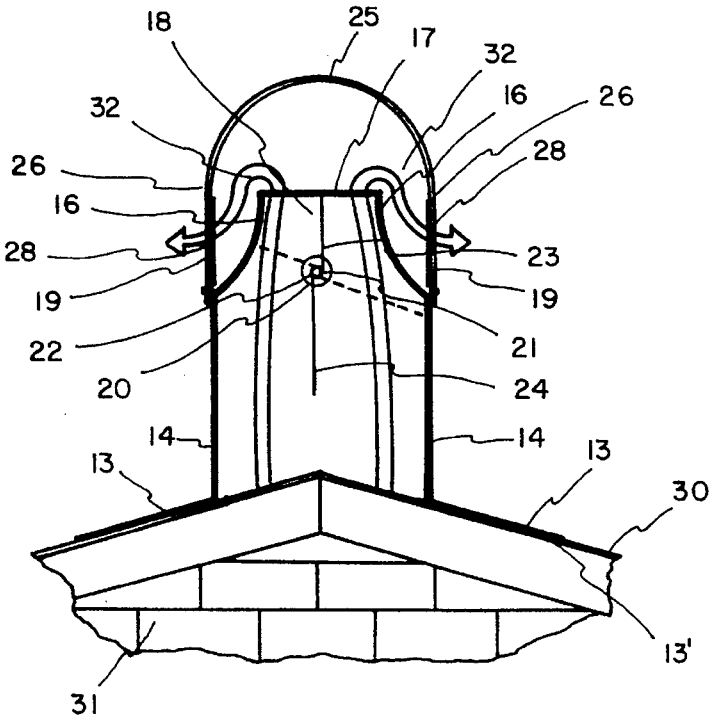
FIG. 4 is a sectional view taken through lines 4—4 FIG. 3 showing the air flow from the interior of the building out through the vertical exhaust ports.

An air control louver 21 includes an elongated shaft 22 that is rotatively mounted on opposite ends to base portion 11 by bearings 20. This air control louver 21 includes a relatively narrow blade portion 23 and a relatively wide blade portion 24. When the louver 21 is open as shown in solid lines in FIG. 4, the weight of the wider blade portion 24 will cause the louver to remain vertical in a pendulum fashion. When the louver is closed as shown in dotted lines in FIG. 4, the narrow blade engages the interior of one of the interior baffles 16 and the wide blade comes into contact with the interior of one of the side walls 14 to effectively cut off the flow of air from the ventilator. Thus it can be seen that by controlling the air flow through the improved roof ventilator 10 of the present invention, the internal temperature of the associated building can be controlled as will hereinafter be discussed in greater detail.

The cap portion 10 of the present invention is molded in one piece and includes a dome shaped top portion 25, vertical side walls 26 and vertical end walls 27.

A plurality of exhaust openings 19 are cut in each of the side walls 26. Bird screens 28 are fixed secured to the interior of each of the side walls covering the exhaust openings 19 therein. These screens are preferably made from either galvanized or stainless steel wire mesh to resist corrosion from exhaust gasses.

To make and use the improved roof ventilator of the present invention, the base portion 11 is molded out of fiberglass or other suitable material with the gel-coat on the exterior thereof. Since similar molding procedures of this type are well known to those skilled in the art, further detailed discussion of the same is not deemed necessary. The cap portion 12 is molded in one piece in a similar manner to the base portion 11.

The cap portion 12 is placed over the base portion 11 with bottom edges 26' of cap sides 26 lying juxtaposed to the upper edge 14' of the base side walls 14. Rivets or other suitable fastening means 29 are then installed to hold the cap portion 12 in place on the base portion 11 to form the improved roof ventilator 10 of the present invention.

The angle of the peripheral flange 13 is designed to be the same as standard roof slopes so that the bottom 13' of such flange will lie juxtaposed to the roof 30 of the building 31.

The peak of the roof that will lie under the ventilator 10 is removed before installing said ventilator. Thus, air flow from the interior of building 31 will move generally as shown by the air flow arrows 32 which moves said air from the interior of building 31 past the open louver 21 and out the open top 18 of the bottom portion 12. The air then turns, flows down the interior deflecting baffles 16 and out adjacent cap exhaust openings 19.

Whenever it is desired to partially or completely close off the air flow through the ventilator a standard chain and sprocket (not shown), or even lines attached to the blade portions 23 and 24 of louver 21 can be used to pivot said louver. Since the pivoting opening and closing of louvers, dampers and the like are well known to those skilled in the art, further detailed discussion of the same is not deemed necessary.

From the above it can be seen that the present invention provides an improved roof ventilator that is relatively simple to manufacture and install and yet is highly efficient in preventing undesirable ingress of water, snow and the like during high wind conditions. At the same time potentially corrosive air and fumes are exhausted high above the roof of the building and outwardly in a generally horizontal direction which is an oblique angle away from the roof.

The present invention may, of course, be carried out in other specific ways than those herein set forth without departing from the spirit and essential characteristics of the invention. The present embodiments are, to be considered in all respects as illustrative and not restrictive, and all changes coming within the meaning and equivalency range of the appended claims are intended to be embraced therein.

What is claimed is:

1. A ventilator for mounting on the roof of a livestock building and other buildings wherein noxious, corrosive fumes are produced comprising: an enclosed corrosion-resistant housing being defined by a pair of generally vertical sidewalls and a pair of generally vertical end walls disposed therebetween and including an upper portion and a lower portion; said upper portion of said housing being dome-shaped in cross-section having a concavely curved interior surface; a peripheral flange outwardly projecting from the lower portion of said housing for lying juxtaposed to said roof; a pair of exhaust ports in each of said pair of generally vertical sidewalls of said housing; a pair of concavely curved in cross-section interior deflecting baffles integrally formed in said lower portion extending upwardly and interiorly from below each of said pair of exhaust ports to above and in spaced relationship to said ports, an open area interior of said baffles communicating with the interior of said building whereby the concavely curved interior surface of said upper portion of said housing and said concavely curved interior deflecting baffles function together to direct air flow carrying noxious, corrosive fumes from the interior of said building, through said exhaust ports, and outwardly away from said roof to prevent degradation thereof by said noxious, corrosive fumes.

2. The ventilator of claim 1 wherein at least one bird screen is provided over said pair of exhaust ports.

3. The ventilator of claim 1 wherein said housing is formed from a moldable material.

4. The ventilator of claim 3 wherein said moldable material is fiberglass.

5. The ventilator of claim 1 wherein an air control means is disposed adjacent said open area interior of said baffles whereby the flow of air and fumes can be regulated from the interior of said building.

6. The ventilator of claim 5 wherein said air control means includes an adjustable louver that is pivotally mounted on the interior of said end walls of said housing whereby said louver may be rotated to close off said open area interior of said baffles to control the flow of fumes and gases.

7. The ventilator of claim 6 wherein said louver is pendulum biased to a normally open position.

* * * * *